United States Patent [19]

Ohya et al.

[11] Patent Number: 4,860,497

[45] Date of Patent: Aug. 29, 1989

[54] DRILL GRINDER HAVING DRILL HOLDER INCLUDING CHUCKS FOR GRIPPING SHANK AND BODY OF THE DRILL

[75] Inventors: Seiji Ohya, Ichinomiya; Tetsuro Harada, Konan, both of Japan

[73] Assignees: Toyo Machinery Co., Ltd.; OSG Corporation, both of Aichi, Japan

[21] Appl. No.: 105,223

[22] Filed: Oct. 7, 1987

[30] Foreign Application Priority Data

Oct. 8, 1986 [JP] Japan ..... 61-239879

[51] Int. Cl.[4] ..... B24B 19/16

[52] U.S. Cl. ..... 51/98.5; 51/165.79; 51/219 PC; 51/288; 279/1 DC; 279/52

[58] Field of Search ..... 51/72 R, 95 R, 98.5, 51/214 R, 219 PC, 288, 165.79; 279/1 DC, 47, 48, 52

[56] References Cited

U.S. PATENT DOCUMENTS

| | | | |
|---|---|---|---|
| 2,313,641 | 3/1943 | Hoerst | 51/219 R |
| 3,621,613 | 11/1971 | Grob et al. | 51/219 R X |
| 3,626,436 | 12/1971 | Lhomme et al. | 51/219 R X |
| 3,916,570 | 11/1975 | Caley | 51/219 R X |
| 4,001,975 | 1/1977 | Bernard et al. | 51/219 PC X |
| 4,468,891 | 9/1984 | Giebmanns | 51/219 PC X |
| 4,485,596 | 12/1984 | Bernard et al. | 51/219 R |
| 4,642,942 | 2/1987 | Guhring | 51/219 PC X |

FOREIGN PATENT DOCUMENTS

| | | | |
|---|---|---|---|
| 474329 | 8/1969 | Switzerland | 51/219 PC |
| 2139930 | 11/1984 | United Kingdom | 51/219 R |

*Primary Examiner*—Robert P. Olsewski

*Attorney, Agent, or Firm*—Oliff & Berridge

[57] ABSTRACT

A drill grinder for grinding a point of a drill including a shank, and a body which has the point. The drill grinder includes a holding device for removably holding the drill, and a grinding wheel adapted to be forced on the drill point, and to thereby grind the point while the drill is held by the holding device. The holding device includes a first chuck for gripping the shank of the drill, and a second chuck for gripping the body of the drill. The grinder has a holder mounting device for removably holding the holder device during a grinding operation on the drill by the grinding wheel. The grinder may further includes a drill setting device for removably accommodating the holding device, to position the drill in a predetermined circumferential position relative to the second chuck, prior to the grind operation.

9 Claims, 11 Drawing Sheets

FIG. 1
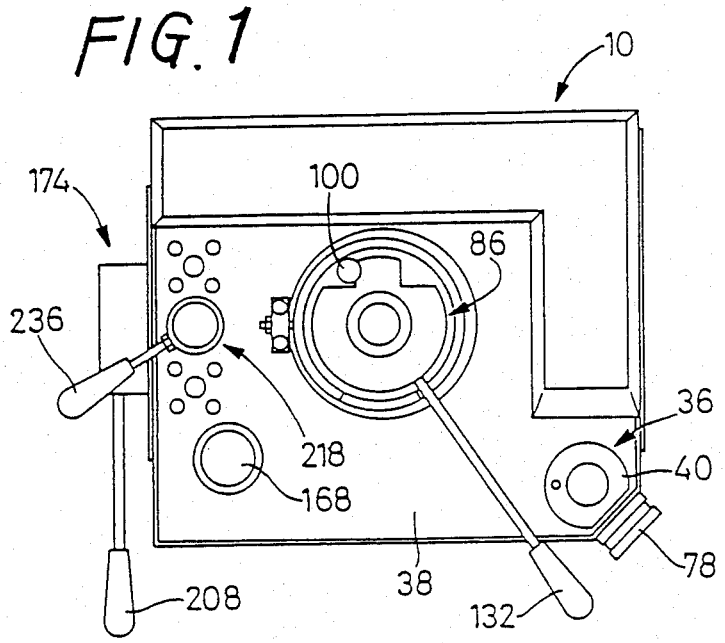
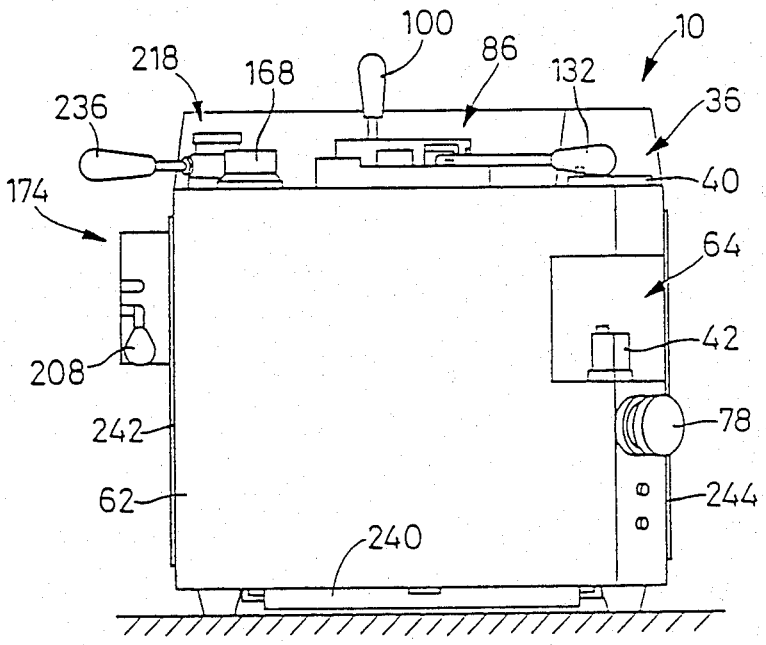
FIG. 2

DRILL GRINDER HAVING DRILL HOLDER INCLUDING CHUCKS FOR GRIPPING SHANK AND BODY OF THE DRILL

BACKGROUND OF THE INVENTION

1. Field of the Invention

The present invention relates to a drill grinder for grinding or sharpening a point of a drill held in a drill holder, by forcing the drill point onto a grinding wheel, and more particularly to a technique for improving the grinding accuracy.

2. Discussion of the Prior Art

Various types of drills are widely used in the art of cutting holes in a workpiece. Since the cutting edges at the point of such drills are subject to wear during service, it is necessary to recondition or sharpen the drill point by grinding. For this purpose, there is known a drill grinder which uses a holding device for removably holding a drill. In this type of drill grinder, the point of the drill held in the holding device is ground such that the drill point and a grinding wheel are forced against each other.

Generally, the drill holding device used in the drill grinder indicated above is adapted to hold a drill at its shank. This means a relatively large distance between the drill point to be ground, and the portion of the drill at which the drill is held or gripped by the holding device. Consequently, the drill tends to be easily elastically deformed due to a grinding force applied between the drill point and the grinding wheel during a grinding operation. Such elastic deformation of the drill causes radial displacement or offsetting of the drill point from the rotating axis of the drill, resulting in deteriorating the accuracy of grinding of the cutting edges at the point of the drill.

SUMMARY OF THE INVENTION

It is accordingly an object of the present invention to provide a drill grinder adapted to solve the conventionally experienced problem described above.

The above object may be attained according to the principle of the present invention, which provides a drill grinder for grinding a point of a drill including a shank, and a body which has the point, the drill grinder comprising a holding device for removably holding the drill, and a grinding wheel adapted to be forced on the point and thereby grind the drill point while the drill is held by the holding device, wherein the holding device includes a first chuck for gripping the shank of the drill, and a second chuck for gripping the body of the drill.

In the drill grinder of the present invention constructed as described above, the drill holding device consists of the first and second chucks, so that the drill is gripped by these two chucks at its two portions, i.e., at the shank and the body. Therefore, the holding device prevents the drill from being elastically deformed during a grinding operation in which the drill point and the grinding wheel are forced against each other. In other words, the holding device protects the drill from otherwise possible radial displacement or offsetting at its point, from the axis of rotation, and accordingly assures improved accuracy of grinding of the drill point to recondition or sharpen the cutting edges.

Usually, the cutting edges to be ground on the instant drill grinder are ground by forcing the lip clearances at the drill point onto the grinding wheel. To this end, the drill must be set on the grinder, at a predetermined circumferential position relative to the grinder. This setting of the drill may be accomplished according to one feature of the present invention, by providing the drill grinder with a holder mounting device for removably holding the holding device during a grinding operation of the drill point by the grinding wheel, and a drill setting device for removably accommodating the holding device. The drill setting device includes a circumferential stop for an abutting contact with one of cutting edges formed at the point of the drill, to position the drill in a circumferential direction relative to the second chuck, prior to the grinding operation. The first and second chucks are adapted to engage each other such that the first and second chucks are rotatable and axially movable relative to each other. The first and second chucks grip the drill such that the drill is held in a predetermined circumferential position relative to the second chuck. This circumferential position is established by the abutting contact of the circumferential stop with the one cutting edge.

In one form of the above feature of the invention, the drill setting device further includes a mounting block for positioning the second chuck in both axial and circumferential positions thereof, and an abutting block which is disposed below the mounting block and which has the circumferential stop. The abutting block has a surface for an abutting contact with the point of the drill such that the body extends through the second chuck, and projects from the second chuck by a predetermined axial distance, and such that the drill is held in a predetermined circumferential position relative to the second chuck. In this case, the drill setting device facilitates accurate setting of the drill in the holding device at the predetermined axial and circumferential positions. It is advantageous that the grinder further comprises adjusting means including a rotary operating member operable to move the abutting block relative to the mounting block in a radial direction of the drill held by the holding device, according to a thickness of a web of the drill, so as to avoid an interference of the circumferential stop with the web. This adjusting means eliminates otherwise required change of the abutting block depending upon the web thickness of the drill to be ground, and accordingly facilitates the setting of the drills having different web thicknesses.

In another form of the above feature of the invention, the second chuck has circumferential positioning means corresponding to a circumferential position of the one cutting edge of the drill. In this instance, each of the drill setting device and the holder mounting device has means engageable with the circumferential positioning means of the second chuck, and the holding device is positioned relative to the holder mounting device by means of the circumferential positioning means. According to this arrangement, the drill preset in the drill holding device at the predetermined circumferential position by the use of the drill setting device can be easily set at the predetermined circumferential position relative to the drill grinder with a little experience, by simply setting the drill holding device in the holder mounting device such that the circumferential positioning means of the second chuck engages the corresponding means provided on the holder mounting device. Thus, the grinding accuracy can be further enhanced.

Where each of the cutting edges of the drill has an arcuate portion near a dead center (axis of rotation) of the drill, it is advantageous that the drill grinder further comprises guiding means for moving the holder mounting device in a radial direction of the drill away from the grinding wheel, and in an axial direction of the drill toward the grinding wheel, as the holder mounting means is rotated about an axis of the drill. In this case, the arcuate portion of the cutting edge may be accurately ground following its profile, with a little experience. The guiding means may use a cam mechanism.

Where the point of the drill has a pair of cutting edges symmetrical with each other with respect to the axis of the drill, and each of the pair of cutting edges includes a first lip clearance and a second lip clearance following the first lip clearance, the guiding means indicated above may be adapted to guide the holder mounting device so as to grind the second lip clearance of one of the pair of cutting edges by an outer circumferential surface of the grinding wheel, while simultaneously grinding the arcuate portion of the other cutting edge by one of opposite surfaces of the grinding wheel. In this case, the drill point may be accurately and efficiently ground even when the profile of the point is considerably complicated.

According to one arrangement of the above form of the invention, the grinder further comprises support means including a support block on which the grinding wheel is supported rotatably about an axis perpendicular to the axis of the drill. The support block is supported pivotably about a pivot axis which is parallel to the axis of the grinding wheel and spaced apart from the axis of the grinding wheel. In this instance, the drill grinder further comprises an operating member for pivoting the support block between a first position in which the grinding wheel grinds the first lip clearance of the drill, and a second position in which the grinding wheel grinds the second lip clearance. This arrangement permits easy changeover of the grinder for grinding the first and second lip clearances having different relief angles.

In a still further form of the above feature of the invention wherein the drill grinder has the holder mounting device, the drill holder further comprises rotary support means for supporting the holder mounting device rotatably about an axis thereof, and an operating member for rotating the holder mounting device and consequently the holding device holding the drill.

In the above case, the drill grinder may includes a pair of parallel guide rods which are inclined relative to the axis of the holder mounting device and are adapted to slidably support the rotary support means. The drill grinder further comprises a cam mechanism which includes a stationary cam, and a cam follower which is secured to the holder mounting device and engageable with the stationary cam to move the rotary support means along the guide rods, when the holder mounting device is rotated by the operating member, whereby a rotary movement of the holder mounting device causes the drill held by the holding device mounted on the holder mounting device, to be moved in a radial direction thereof away from the grinding wheel, and in an axial direction thereof toward the grinding wheel. According to this arrangement, the holder mounting device may be moved simultaneously along three axes, that is, may be radially and axially moved while being rotated about its axis, following the configuration of the drill point, by simply operating the operating lever. The profile of the stationary cam, and the angle of inclination of the guide rods may be suitably determined, depending upon the configuration of the drill point to be ground.

Preferably, the stationary cam indicated above consists of a peripheral cam in the form of a plate having a cam surface, and the cam mechanism further includes a pin which extends parallel to the axis of the holder mounting device, to support the peripheral cam pivotally. In this case, the drill grinder further comprises an operating member for pivoting the peripheral cam about the pin to change a position of the cam surface relative to the cam follower, according to a diameter of the drill. This arrangement eliminates a need of changing the stationary cam from one to another, depending upon the diameter of the drill.

BRIEF DESCRIPTION OF THE DRAWINGS

The above and optional objects, features and advantages of the present invention will be better understood by reading the following detailed description of a presently preferred embodiment of the invention, when considered in connection with the accompanying drawings, in which:

FIG. 1 is a plan view of one embodiment of a drill grinder of the present invention;

FIG. 2 is a front elevational view of the drill grinder of FIG. 1;

DETAILED DESCRIPTION OF THE PREFERRED EMBODIMENT

The presently preferred embodiment of the invention will be described in detail, by reference to the accompanying drawings.

Figure 3:
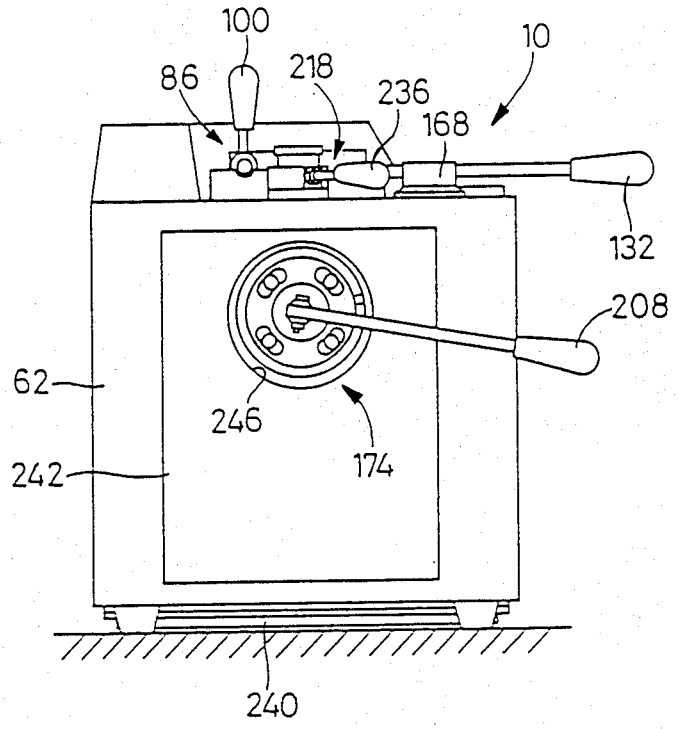
FIG. 3 is a left side elevational view of the drill grinder of FIG. 1.
Figure 4:
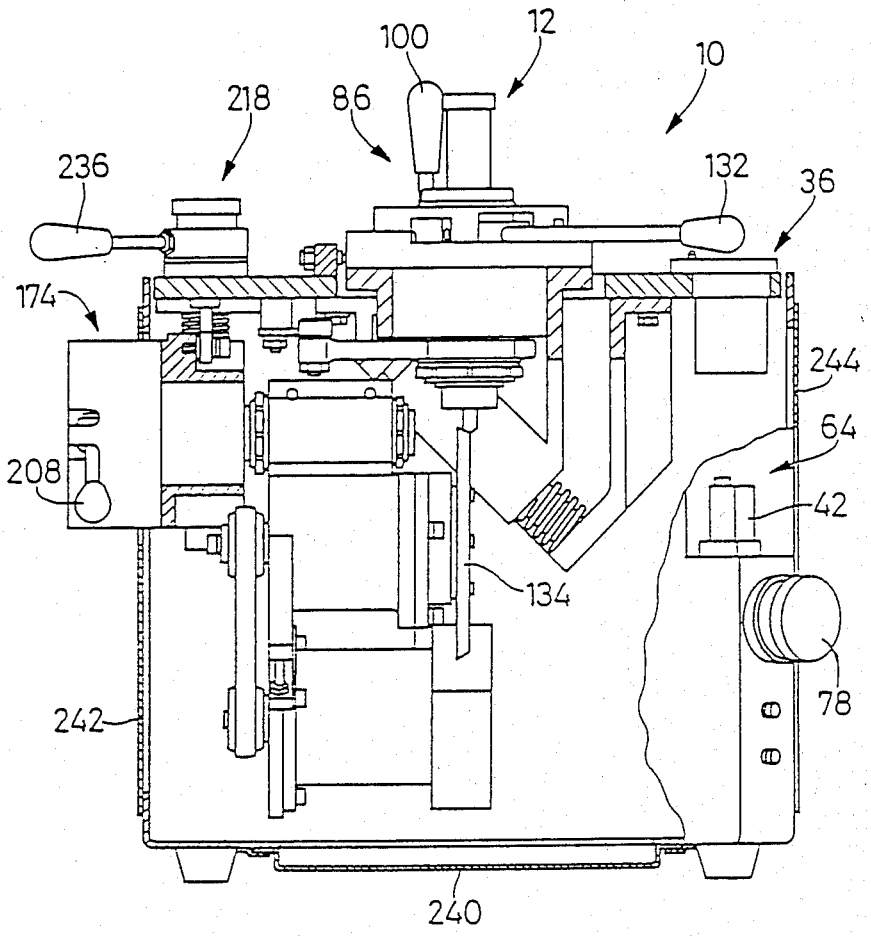
FIG. 4 is a front elevational view in cross section of the drill grinder of FIG. 1.
Figure 5:
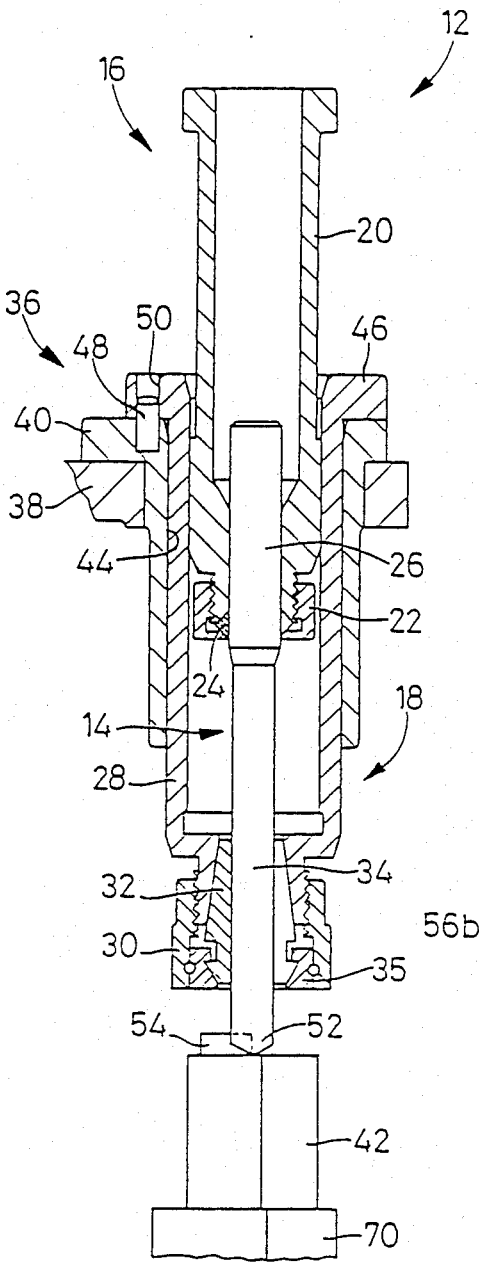
FIG. 5 is an elevational view in cross section of a drill holder set in a drill setting device provided on the grinder of FIG. 1.

Referring first to the plan view of FIG. 1, and the front and left side elevational views of FIGS. 2 and 3, there is shown a drill grinder generally indicated at 10. In the front elevational view of FIG. 4, a drill holder 12 is shown as installed in place in the instant drill grinder 10. As depicted in FIG. 5, the drill holder 12 serves as a drill holding device for removably holding a drill 14 which is to be ground on the drill grinder 10. The drill holder 12 consists of a first chuck 16 and a second chuck 18. The first chuck 16 has a hollow cylindrical member 20, and a nut 22 threaded on an end portion of the cylindrical member 20. Between the end portion of the cylindrical member 20, and the nut 22, there is interposed a collet 24 which has eight slits. The collet 24 is radially inwardly compressed between the cylindrical member 20 and the nut 22, when the nut 22 is tightened on the cylindrical member 20. Thus, a shank 26 of the drill 14 is gripped by the first chuck 16.

Like the first chuck 16, the second chuck 18 has a hollow cylindrical member 28, and a nut 30 threaded on an end portion of the cylindrical member 28. With the nut 30 tightened on the cylindrical member 28, a collet 32 having eight slits is radially inwardly compressed against a body 34 of the drill 14, whereby the body 34 is gripped by the second chuck 18. The cylindrical member 28 has a larger diameter than the cylindrical member 20. The first chuck 16 is partially fitted in the cylindrical member 28 of the second chuck 18, such that the first and second chucks 16, 18 are rotatable and axially movable relative to each other. The collet 32 has an axial length which is sufficiently larger than an axial dimension of helical flutes or grooves **56*a*, 56*b* formed in the body 34 of the drill 14. The collet 32 is adapted to be forced against the outer circumferential surface of the drill body 34, and engages the nut 30, such that the collet 32 and the nut 30 are rotatable relative to each other, via a ring 35** interposed therebetween.

The drill grinder 10 includes a drill setting device 36 for holding the drill 14 in the drill holder 12, so that the drill 14 is placed in a predetermined circumferential position. The drill setting device 36 has a mounting block 40 secured to a top plate 38 of the body of the grinder 10, and an abutting block 42 disposed below the mounting block 40. As indicated in FIG. 5, the mounting block 40 has a through-hole 44 through which the cylindrical member 28 of the second chuck 18 extends, such that one end portion of the cylindrical member 28 is located near the abutting block, while an outward flange 46 formed at the other end portion is held in abutting contact with an upper end face of the mounting block 40. The mounting block 40 has a positioning pin 48 which projects from the upper end face. On the other hand, the second chuck 18 has a positioning hole 50 formed in the outward flange 46 of the cylindrical member 28. With the positioning pin 48 engaging the positioning hole 50, the second chuck 18 is placed in a predetermined circumferential position relative to the mounting block 40.

The first chuck 16 gripping the inserted drill 14 at its shank 26 is inserted into the hollow cylindrical member 28 of the second chuck 18 thus fixed in the mounting block 40, such that a point 52 of the drill 14 is held in abutting contact with an upper surface of the abutting block 42. In this manner, a desired distance of projection of the body 34 of the drill 14 from the second chuck 18 is established. Namely the abutting block 42 is spaced away from the mounting block 40 by a predetermined distance in the downward direction.

Figure 6:
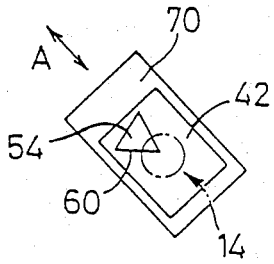
FIG. 6 is a plan view of an abutting block of the drill setting device of FIG. 5.
Figure 7:
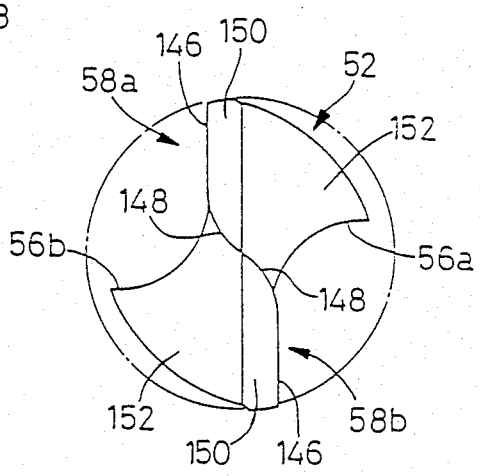
FIG. 7 is a view showing a point of a drill to be ground on the drill grinder of FIG. 1.

The abutting block 42 is provided on its upper surface with a circumferential stop 54, which has a triangular shape as viewed in a plan view of FIG. 6. This circumferential stop 54 is adapted to engage one of the two helical flutes or grooves **56*a*, 56*b* of the drill 14 held by the mounting block 40 through the drill holder 12. Described more specifically referring to FIG. 7, the point 52 of the drill 14 has a pair of cutting edges 58*a*, 58*b* which are symmetrical with each other with respect to an axis of rotation of the drill 14, i.e., with respect to the dead center of the point 52. The pair of helical flutes 56*a*, 56*b* terminate at the point 52, and allow cutting chips produced by the cutting edges 58*a*, 58*b* to escape from a hole cut in a workpiece by the drill 14. The circumferential stop 54 indicated above is formed so as to be engageable with the helical flute 56*a* or 56*b*. To circumferentially position the drill 14 after the point 52 is brought into abutment on the abutting block 42, the drill 14 is rotated by rotating the chuck 16, until the cutting edge 58*a* or 58*b* at the point 52 comes into contact with a side face 60 of the stop 54. Thus, the drill 14 is held in a predetermined circumferential position relative to the second chuck 18**.

In this condition, the nut 30 of the second chuck 18 is tightened, whereby the drill 14 is clamped by the second chuck 18, with the predetermined distance of projection from the second chuck 18, and at the predetermined circumferential angular position relative to the drill holder 12. Thus, the drill setting device 36 provided in the instant drill grinder 10 is capable of readily positioning the drill 14 in the drill holder 12, with correct axial and circumferential orientations. As shown in FIG. 2, the abutting block 42 is disposed within a recess 64 formed in a right-hand side end portion of a front plate 62 covering the front side of the drill grinder 10, and the nut 30 of the second chuck 18 is accessible through this recess 64.

Figure 8:
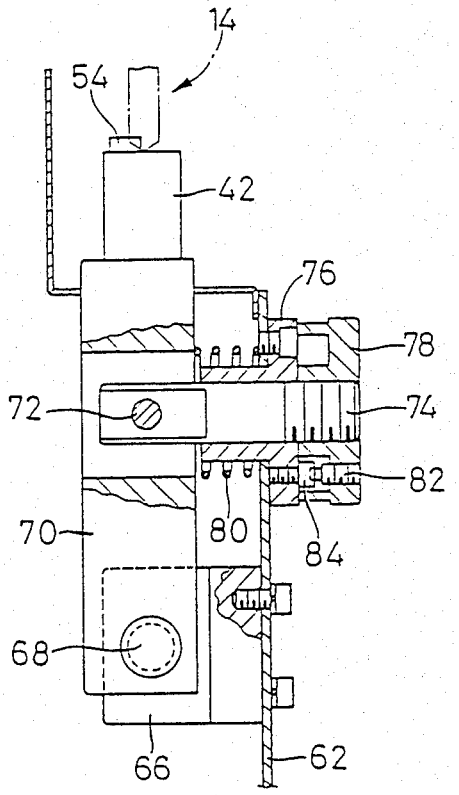
FIG. 8. is a fragmentary elevational view of the drill grinder, showing a part of the drill setting device of FIG. 5, which includes the abutting block.

As illustrated in FIG. 8, the abutting block 42 is secured to an upper end of a pivot arm 70 which is pivotally supported by a bracket 66 fixed to the inside of the front plate 62. The bracket 66 has a support pin 68 about which the pivot arm 70 is adapted to pivot. The pivot arm 70 is connected at its intermediate portion to a shaft 74, through a pin 72 parallel to the pin 68. The end portion of the shaft 74 remote from the pin 72 extends through a bushing 76 secured to the front plate 62, and projects away from the bushing 76. The projecting end of the shaft 74 is threaded to an operating member in the form of a knob 78.

Between the pivot arm 70 and the front plate 62, there is disposed a compression coil spring 80, which serves to bias the pivot arm 70 in a counterclockwise direction as viewed in FIG. 8. Accordingly, the operating knob 78 is normally held in contact with the bushing 76. In this arrangement, a rotating movement of the operating knob 78 will cause the pivot arm 70 to be pivoted about the pin 68, whereby the abutting block 42 is moved in one of opposite directions indicated at A in FIG. 6.

Thus, the position of the abutting block 42 can be adjusted, depending upon a specific wall thickness of the drill 14, so as to avoid an interference of the circumferential stop 54 with the web, during the positioning of the drill 14 in the drill holder 12 by the drill setting device 36. Therefore, the instant arrangement eliminates the use of different abutting blocks for various drills having different web thicknesses, and assures quick adjustment of the position of the abutting block in the radial direction of the drill 14. As is apparent from FIG. 6, the directions A in which the abutting block 42 is moved is not parallel to the side face 60 of the stop 54, because the size of the cutting edges 58*a*, 58*b* is varied as the wall thickness of the web of the drill 14 is changed. An axial movement of the operating knob 78 is limited by means of abutting contact of a stopper pin 82 fixed to the knob 78, with a bolt 84 fixed to the bushing 76.

As described above, the use of the drill setting device 36 permits positioning of the drill 14 in the drill holder 12, with the predetermined distance of projection of the drill 14 from the second chuck 18, and at the predetermined angular position. The drill holder 12 thus holding the drill 14 is then removably set in a holder mounting device 86, which is disposed in a central part of the upper portion of the grinder 10. FIG. 4 shows the grinder 10 in this condition.

Figure 9:
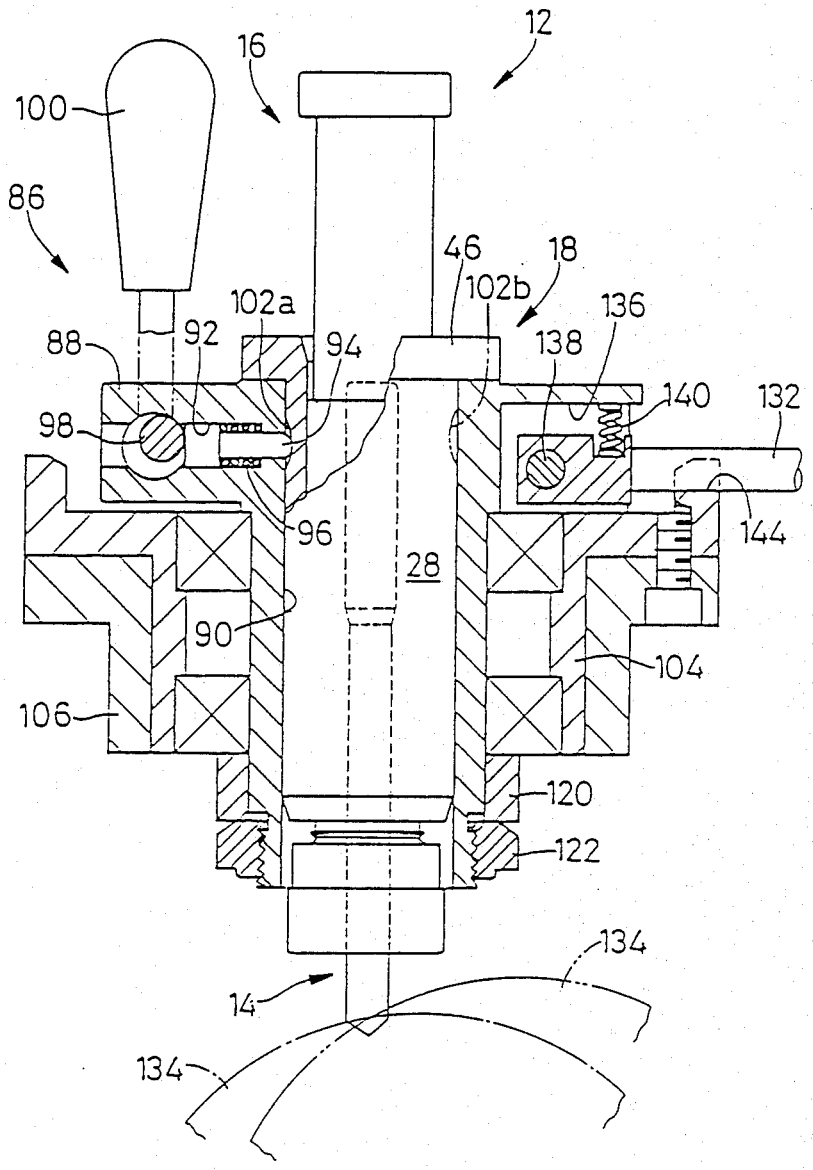
FIG. 9 is an elevational cross sectional view illustrating a holder mounting device of the drill grinder, in which the drill holder is mounted, the view being taken along line IX—IX of FIG. 10.
Figure 10:
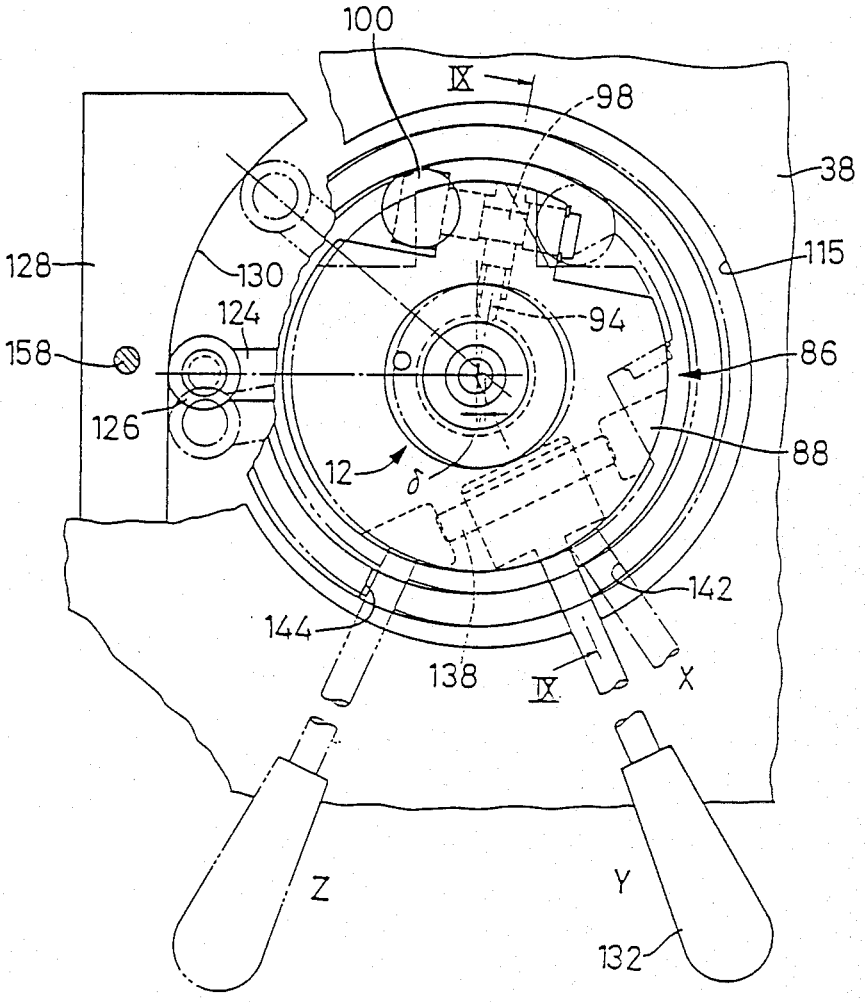
FIG. 10 is a partially cut-away plan view of the holder mounting device of FIG. 9.

The holder mounting device 86 includes a mounting block 88 as shown in FIGS. 9 and 10. The mounting block 88 has a through-hole 90 in which the hollow cylindrical member 28 of the second chuck 18 is fitted, such that the outward flange 46 of the cylindrical member 28 is held in abutting contact with the outer end face of the mounting block 88.

The mounting block 88 has a radial hole 92 which is formed so as to extend perpendicularly to the through-hole 90. A positioning pin 94 is slidably received within the radial hole 92, so that the inner end of the pin 94 may project into the through-hole 90. A compression coil spring 96 is disposed around the positioning pin 94 in the radial hole 92, so that the pin 94 is biased in a longitudinal direction away from the through-hole 90, whereby the positioning pin 94 is held in abutting contact with an eccentric cam 98 disposed in a portion of the hole 92 remote from the through-hole 90. The eccentric cam 98 is rotated about an axis perpendicular to the radial hole 92, by operating a positioning clamp lever 100. The positioning pin 94 and the eccentric cam 98 are formed so that the pin 94 is moved between an advanced position in which the inner end projects into the through-hole 90, and a retracted position in which the inner end is positioned within the radial hole 92.

On the other hand, a pair of cutouts 102*a*, 102*b* are formed in the outer circumferential surface of the cylindrical member 28 of the second chuck 18. These two cutouts 102*a*, 102*b* are located at diametrically opposite positions of the cylindrical member 28, so that the inner end of the positioning pin 94 placed in the advanced position is engageable with either one of the cutouts 102*a*, 102*b*. Like the positioning hole 50 engageable with the pin 48 of the drill setting device 36, the cutouts 102*a*, 102*b* serve as a circumferential positioning portion engageable with the positioning pin 94 of the holder mounting device 86. That is, the second chuck 18 (drill holder 12) is first circumferentially positioned such that the desired one of the cutouts 102*a*, 102*b* is aligned with the positioning pin 94 in the retracted position, and the clamp lever 100 is then manipulated to advance the positioning pin 94 for engagement with the cutout 102*a*, 102*b*. In this manner, the second chuck 18 is firmly clamped in the through-hole 90 in the mounting block 88, at the predetermined axial and circumferential positions.

Since the drill 14 is held in the drill holder 12 at the predetermined axial and circumferential positions as previously discussed, the drill 14 is eventually oriented at the predetermined axial and circumferential positions with respect to the mounting block 88, by setting the drill holder 12 in the mounting block 88 as described above. Consequently, the desired one of the cutting edges 58*a* and 58*b* at the point 52 of the drill 14 is brought into a predetermined grinding position, and this position is maintained. It will be understood that the pair of cutouts 102*a*, 102*b* are provided corresponding to the pair of cutting edges 58*a*, 58*b*. After one of the cutting edges 58*a*, 58*b* has been ground, the second chuck 18 is unclamped and rotated by 180 degrees about its axis. Then, the second chuck 18 is clamped with the other cutting edge 58*a*, 58*b* in the grinding position.

Figure 11:
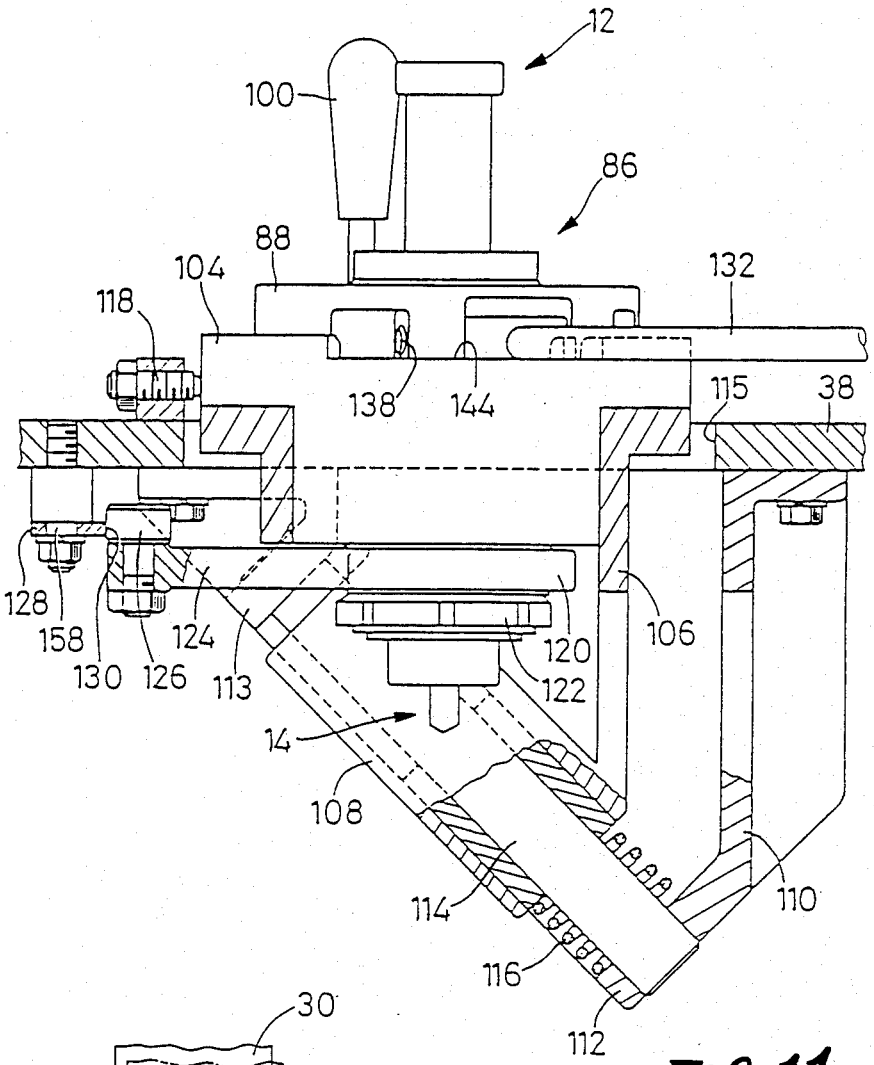
FIG. 11 is an elevational cross sectional view, depicting a cam mechanism for translating the holder mounting device of FIG. 9.

As shown in FIG. 9, the holder mounting device 86 is supported by a cylindrical block 104, via a pair of bearings, such that the mounting device 86 is rotatable about its axis. The cylindrical block 104 is fixed to a support frame 106. As illustrated in FIG. 11, the support frame 106 has a pair of inclined parallel sleeves 108 (one of which is shown) integrally formed at its lower portion. On the other hand, a bracket 110 secured to the top plate 38 has support portions 112, 113 which support a pair of parallel inclined guide rods 114 (one of which is shown in FIG. 11). The guide rods 114 slidably engage the respective sleeves 108 of the support frame 106. The top plate 38 has a round opening 115 through which the holder mounting device 86 extends. This opening 115 has a sufficient diameter so as to permit a radial movement of the holder mounting device 86, as described below.

Since the sleeves 108 and the guide rods 114 are inclined relative to the axis of the holder mounting device 86, the mounting device 86 is movable along an inclined path parallel to the guide rods 114, while being supported by the guide rods. A compression coil spring 116 is disposed between each sleeve 108 and the corresponding support portion 112, whereby the holder mounting device 86 is normally held in its original or rest position in which the cylindrical block 104 is in abutting contact with a stop member 118 secured to the top plate 38. As indicated above, the support arrangement, which includes the cylindrical block 104, the pair of sleeves 108 and the pair of guide rods 114, permits the holder mounting device 86 to be rotated about its axis, and translated parallel to the guide rods 114, while maintaining the horizontal posture as indicated in FIG. 11.

As shown in FIG. 9, a bearing retainer 120 is fitted on the lower end portion of the mounting block 88 of the holder mounting device 86. The bearing retainer 120 is held in place by a nut 122, and is secured to the mounting block 88 by means of an engaging tab (not shown) formed thereon. The bearing retainer 120 has an integrally formed, radially extending arm 124 as shown in FIGS. 10 and 11. This arm 124 has a cam follower 126 rotatably supported at its free end. The cam follower 126 is rotatable about an axis parallel to the axis of rotation of the mounting block 88, and is adapted to be engageable with a cam surface 130 formed on a peripheral cam 128 in the form of a plate attached to the top plate 38.

Described more specifically, the cam surface 130 of the cam 128 is formed such that the cam follower 126 engages the cam surface 130 while a rotating lever 132 connected to the mounting block 88 is moved from a position Y indicated in solid line in FIG. 10, to a position Z indicated in two-dot chain line in the same figure. This engagement between the cam follower 126 and the cam surface 130 causes the mounting block 88 to be moved obliquely while being guided by the guide rods 114, in the right-downward direction as seen in FIG. 11. As a result, the drill 14 held in the drill holder 12 is accordingly moved in the oblique direction, that is, in the radially rightward direction by a distance δ and in the axially downward direction, at the same time, as indicated in solid and two-dot chain lines in FIG. 12. The cam follower 126 and the peripheral plate cam 128 constitute a cam mechanism for effecting the radial and axial movements of the holder mounting device 86 (drill 14) concurrently with the rotational movement of the same.

The rotating lever 132 is connected to the mounting block 88, pivotally about a connecting pin 138 which is disposed in a recess 136 formed in the block 88, such that the pin 138 extends perpendicularly to the axis of the mounting block 88, as shown in FIG. 9. The rotating lever 132 is biased in the downward direction by a compression coil spring 140, whereby the lever 132 is normally held in pressed contact with the upper surface of the cylindrical block 104. More particularly, the cylindrical block 104 has cutouts 142, 144 formed in its upper surface, as shown in FIG. 10. The lever 132 engages the cutout 142 when the lever 132 is placed in a position X, and engages the cutout 144 when the lever 132 is located between the positions Y-Z.

Referring back to FIG. 7, each of the cutting edges **58*a* and 58*b* at the point 52 of the drill 14 to be ground has a radially outer straight portion 146, and a radially inner arcuate portion 148 formed at the extremity of the web. The drill 14 has a pair of first lip clearances 150 symmetrical with each other with respect to the dead center or the axis of the drill, and a pair of second lip clearances 152 also symmetrical with each other. To recondition the drill point 52, the arcuate portion 148** as well as the first and second lip clearances of each cutting edge must be ground.

Figure 12:
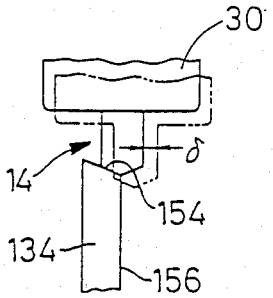
FIG. 12 is an explanatory view illustrating a positional relation between the drill moved by the cam mechanism of FIG. 11, and a grinding wheel of the grinder.

The angular position X of the rotating lever 132 indicated above is determined so that the first lip clearance 150 of the drill 14 faces a circumferential surface 154 of a grinding wheel 134 (FIG. 12). Namely, the first lip clearance 150 is ground while the lever 132 is maintained in the position X. On the other hand, the angular positions Y-Z are determined so that the opposite circumferential ends of the second lip clearance 152 face the circumferential surface 154 of the wheel 134. That is, the second lip clearance 152 is ground by turning the lever 132 from the position Y to the position Z. In this grinding operation caused by the rotary movement from the position Y to the position Z, the cam mechanism indicated above causes the drill 14 to be moved radially in a direction away from the grinding wheel 134, and axially toward the axis of the wheel 134. If the second lip clearance 152 of the cutting edge **58*a* is ground, for example, the above radial and axial movements of the drill 14 permit the arcuate portion 148 of the other cutting edge 58*b* to be ground by a face 156 (one of opposite major surfaces) of the drill 14. To achieve the grinding of the arcuate portion 148, the angle of inclination of the guide rods 114, and the profile of the cam surface 130 are determined based on the specific configuration of the arcuate portion 148. Thus, the instant arrangement allows for three-dimensional movements of the drill 14 by simply operating the rotating lever 132, which permit accurate and efficient grinding paths following a complicated profile of the drill point 52**. Yet, the arrangement is relatively simple and therefore inexpensive.

Figure 13:
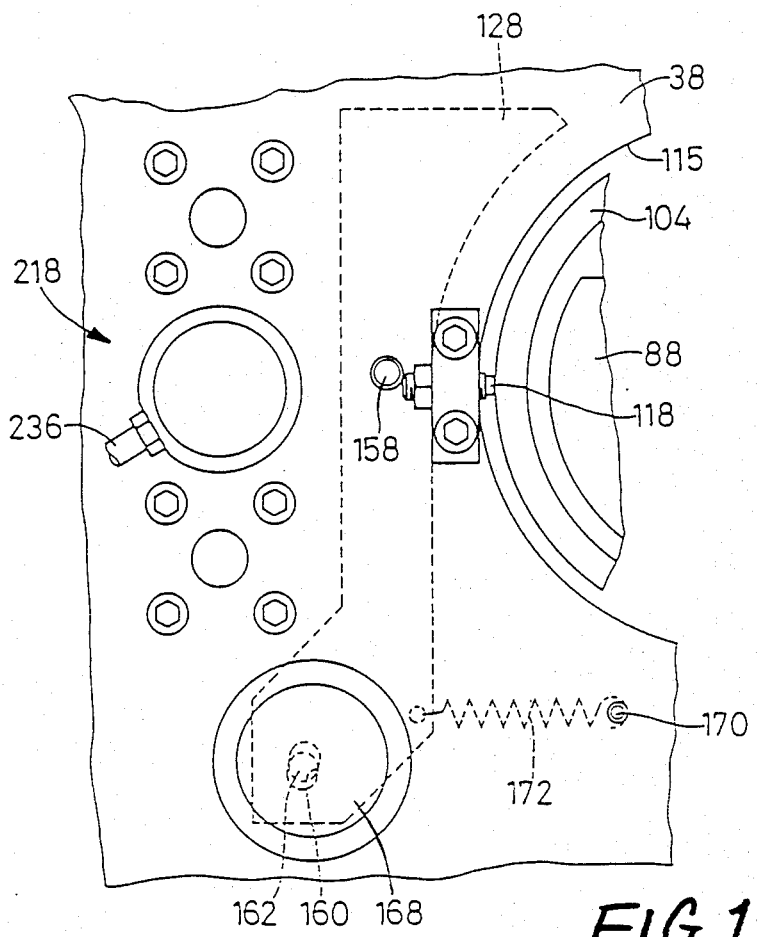
FIG. 13 is a plan view showing a cam of the cam mechanism of FIG. 11.
Figure 14:
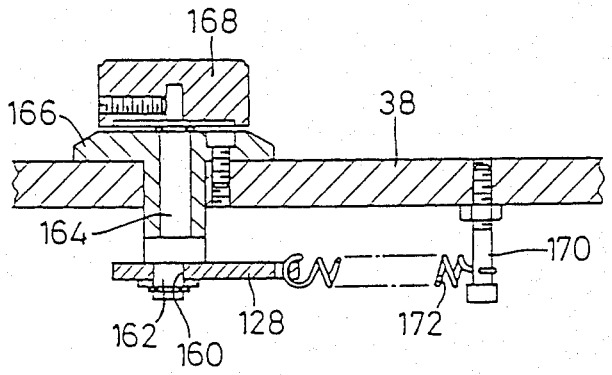
FIG. 14 is a cross sectional view of one end portion of the cam of FIG. 13.

As shown in FIG. 13, the peripheral plate cam 128 has a generally elongate shape and is supported at an intermediate portion thereof by the top plate 38, pivotally about a pin 158 which extends from the underside of the top plate 38. As also shown in FIG. 14, the plate cam 128 has an elongate or oval hole 160 formed at its one end. The oval hole 160 engages an eccentric pin 162 eccentrically formed on the lower end of a shaft 164 perpendicular to the cam 128. The shaft 164 is rotatably supported by a bushing 166 fixed to the top plate 38, such that the upper end protrudes above the bushing 166. The shaft 164 is fixed at its upper end to an operating knob 168. According to this arrangement, a rotating movement of the knob 168 causes a pivotal movement of the plate cam 128 about the pin 158, thereby changing the radial movement distance δ and the axial advancing movement of the drill 14, relative to the grinding wheel 134, which take place when the rotating lever 132 is operated between the positions Y and Z. In other words, the radial and axial movement distances of the drill 14 can be easily adjusted according to the specific diameter of the drill 14 to be ground, by manipulating the operating knob 168. This arrangement eliminates otherwise required change of the cam 128 from one type to another. To avoid rattling movements of the cam 128, a tension coil spring 170 is connected between the end portion of the cam 128 near the oval hole 160, and a pin 170 fixed to the top plate 38.

On the left-hand side of the drill grinder 10, there is incorporated a wheel positioning device 174 for moving the axis of the grinding wheel 134 between two positions, by pivoting a wheel drive assembly described below. Described in greater detail referring to FIGS. 15 and 16, the wheel positioning device 174 is disposed on a bracket 178 suspended by a hook 176. The bracket 178 is vertically guided by a pair of guide rods 180 secured to the top plate 38. The bracket 178 is biased in the downward direction by a pair of compression coil springs 182 disposed around the upper portions of the respective guide rods 180.

To the bracket 178, there is secured a cylindrical block 184 through which a shaft 186 extends. The shaft 186 is rotatable via bearings relative to the cylindrical block 184, but is immovable relative to the block 184 in the axial direction. The shaft 186 has an axis of rotation which is perpendicular to the axis of the holder mounting device 86, i.e., perpendicular to the axis of the drill 14. A support block 188 is secured to the end portion of the shaft 186 which projects from the cylindrical block 184, so that the support block 188 is rotated with the shaft 186.

Figure 15:
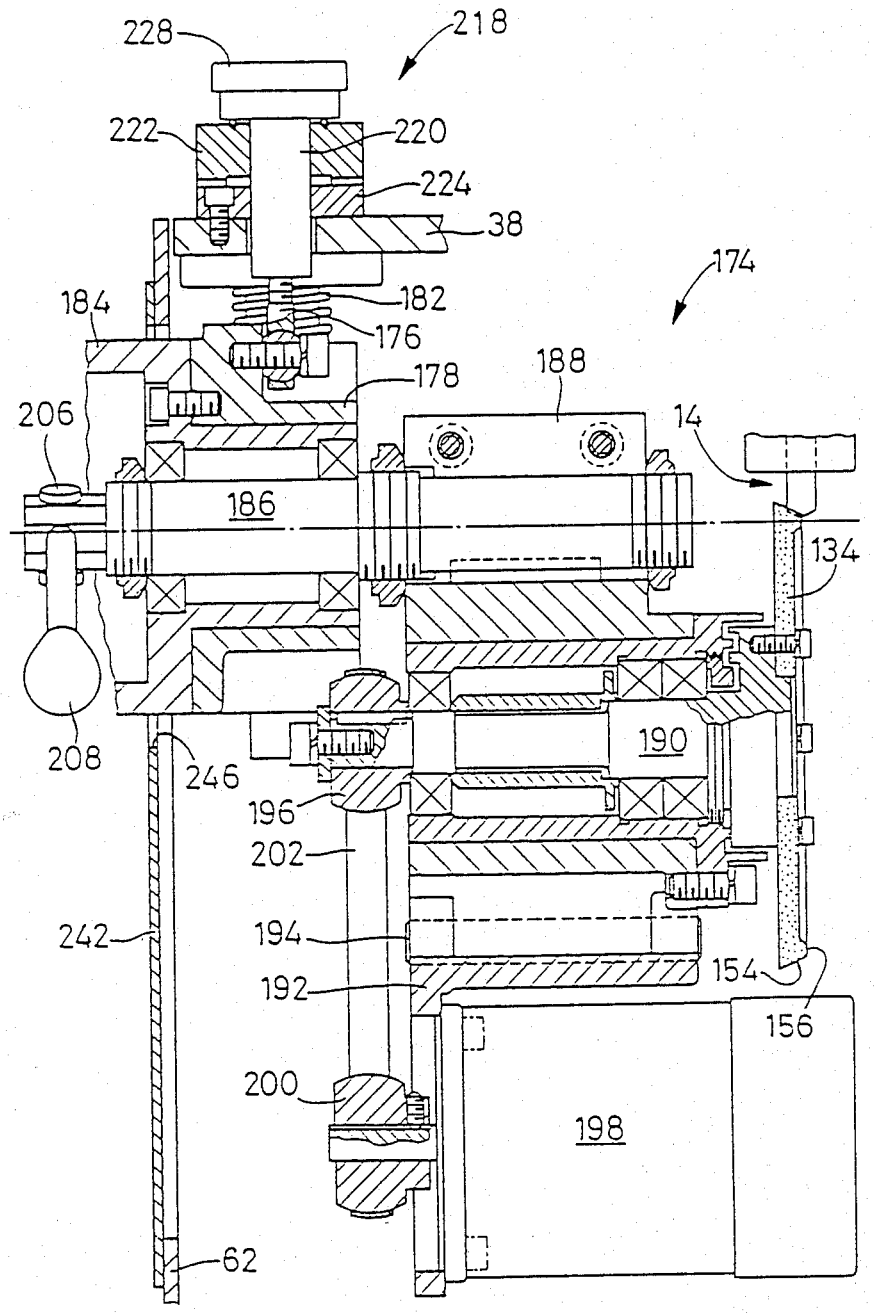
FIG. 15 is an elevational cross sectional view showing a wheel-axis positioning device and an elevator device of the grinder of FIG. 1.
Figure 16:
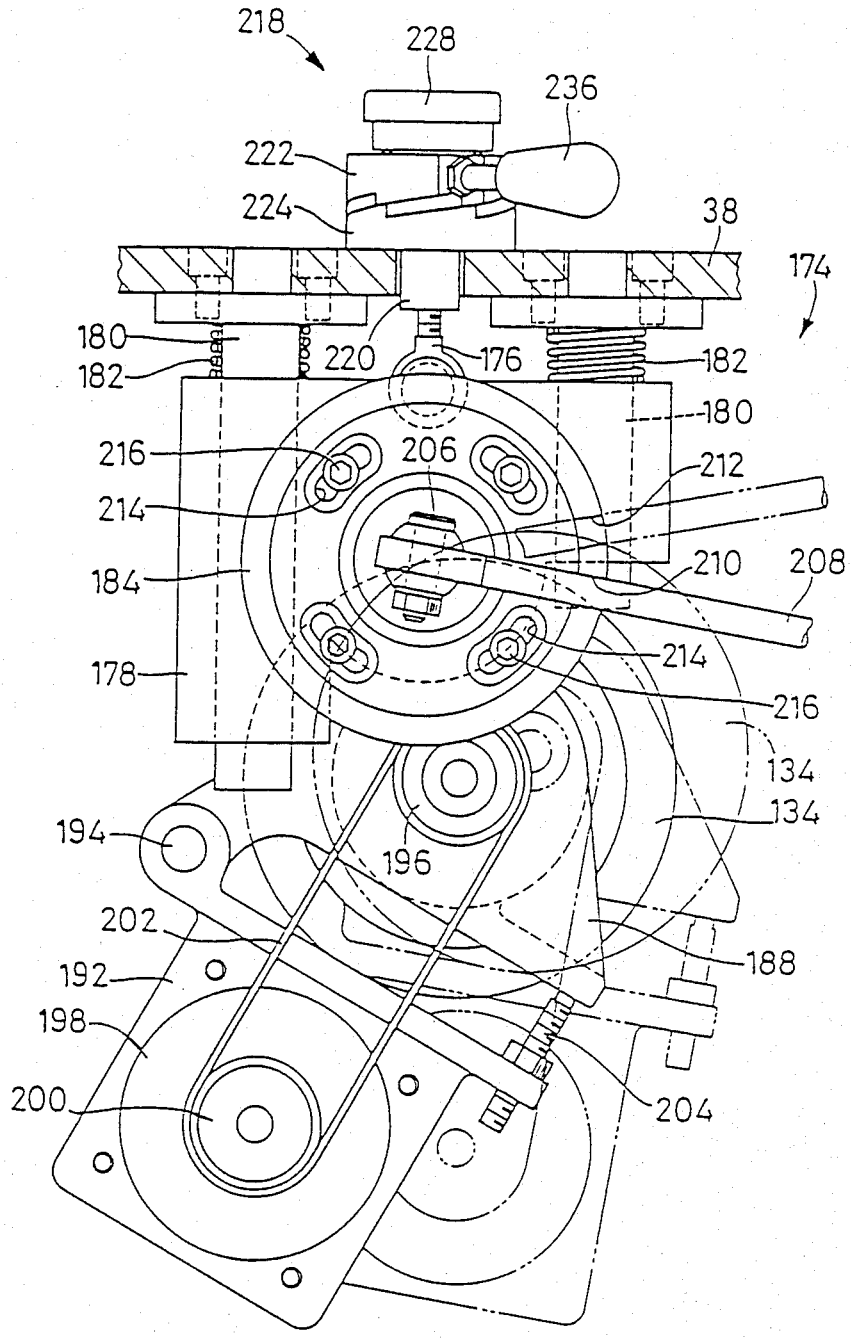
FIG. 16 is a left side elevational view of FIG. 15, with a side plate of the grinder removed.

The support block 188 has bearings for rotatably supporting a wheel support shaft 190, which is disposed parallel to the shaft 186 and is axially immovable relative to the support block 188. The support block 188 further has a motor bracket 192 fixed thereto such that the bracket 192 is pivotable about a pin 194 parallel to the shaft 186. The grinding wheel 134 is attached to one end of the wheel support shaft 190, while a pulley 196 is attached to the other end of the shaft 190. The pulley 196 is connected by a belt 202 to another pulley 200 which is fixed to an output shaft of a drive motor 198 mounted on the motor bracket 192. Thus, the grinding wheel 134 is operatively coupled to the drive motor 198. The motor bracket 192 is provided with an adjusting screw 204 threaded thereto for adjusting a pivotal position of the bracket 192 about the pin 194 relative to the support block 188, and thereby adjusting a tension of the belt 202. It is noted that a lower part of the cross sectional view of FIG. 15 showing the motor assembly (below the wheel support shaft 190) is taken in a plane which includes the axes of rotation of the shaft 190 and the motor 198.

To the outer end of the shaft 186 projecting outwardly from the cylindrical block 184, there is connected a wheel-axis positioning lever 208 through a pin 206, which extends perpendicularly to the shaft 186. The cylindrical block 184 has two cutouts 210, 212 formed in its end face. The support block 188 may be pivoted about the shaft 186 by turning the lever 208 between the positions corresponding to the cutouts 210, 212. Namely, with the lever 108 engaging the cutout 210, the axis (shaft 190) of the grinding wheel 134 is placed in a first position (indicated in solid line in FIG. 16) for grinding the first lip clearance 150 of the drill 14. With the lever 208 engaging the cutout 212, the axis of the grinding wheel 134 is placed in a second position (indicated in two-dot chain line in FIG. 16) for grinding the second lip clearance 152. The first and second positions are determined so that the grinding paths taken by the grinding wheel 134 placed in these positions correspond to the clearance angles of the first and second lip clearances 150, 152, respectively. The grinding paths taken by the grinding wheel 134 when placed in the first and second positions are indicated in one-dot and two-dot chain lines in FIG. 9, respectively, with respect to the drill 14. Thus, the grinding wheel 134 may be easily moved between the two radial positions for grinding the first and second lip clearances 150, 152, by simplying manipulating the wheel-axis positioning lever 208. The cylindrical block 184 is secured to the bracket 178 by four bolts 216 which extend through corresponding elongate holes 214, so that the circumferential position of the cylindrical block 184 relative to the bracket 178 may be adjusted, depending upon the clearance angles of the drill 14.

Figure 17:
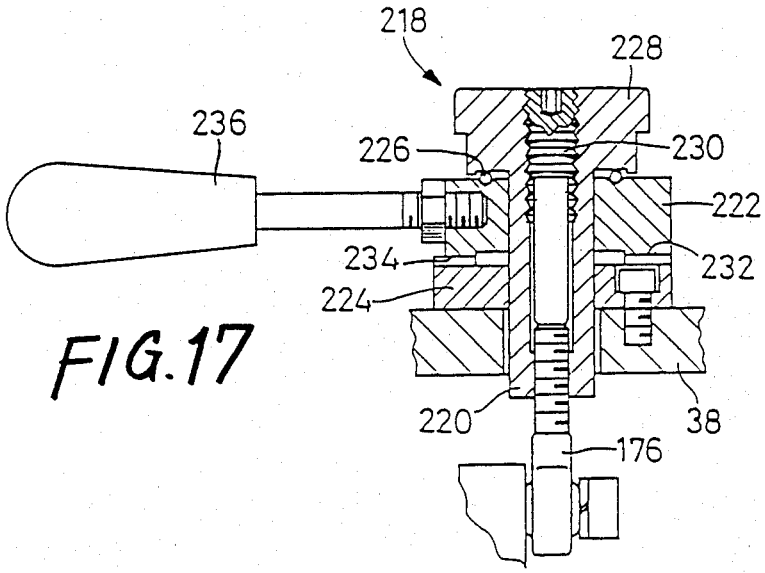
FIG. 17 is a fragmentary elevational view in cross section of the elevator device of FIG. 15.

The hook 176 suspending the wheel-axis positioning device 174 is threaded in a lower portion of a hollow elevator rod 220 of a wheel elevator 218. As also shown in FIG. 17, the elevator rod 220 extends through a rotatable cam 222, a stationary cam 224 and the top plate 38, such that the rod 220 is axially movable relative to these members 222, 224, 38. The elevator rod 220 has an integrally formed head 228 which rests on the upper surface of the rotatable cam 222 via a thrust bearing 226. A lock bolt 230 is threaded in an upper portion of the hollow elevator rod 220, such that the lower end of the bolt 230 is in abutting contact with the upper end of the hook 176. Thus, the hook 176 is connected to the rod 220 so as to prevent a relative rotational movement therebetween.

Figure 18:
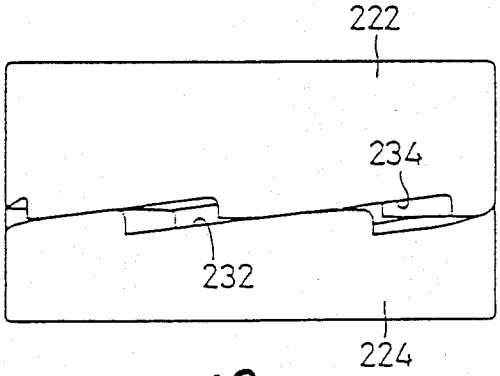
FIG. 18 is a front elevational view showing a rotatable cam and (a stationary cam shown in FIG. 17.

The stationary cam 224 is fixed to the top plate 38, and has a circumferential cam surface 234 on a radially outer portion of its upper surface, as indicated in FIG. 18. The rotatable cam 222 is supported rotatably relative to the elevator rod 220, and has a cam surface 232 on a radially outer portion of its lower surface. An elevator lever 236 is fixed to the rotatable cam 222, so as to extend radially from the circumferential surface of the cam 222. The cam surfaces 232, 234 are formed so that the rotatable cam 222 and the elevator rod 220 are elevated and lowered as the cam 222 is rotated by the lever 236. In this arrangement, the wheel-axis positioning device 174 suspended by the elevator rod 220 can be elevated and lowered between the predetermined uppermost and lowermost positions, by manipulating the lever 236.

A length of engagement of the hook 176 with the elevator rod 220, that is, a relative position between the hook 176 and the rod 220 in the longitudinal direction is adjusted so that the grinding wheel 134 is located a predetermined small distance below the point 52 of the drill 14 when the rod 220 is placed in the lowermost position. More precisely stated, when the grinding wheel 134 is placed in the lowermost position, its periphery is spaced downwardly from the drill point 52 by a distance smaller than an operating stroke of the elevator rod 220. Accordingly, the periphery of the grinding wheel 134 comes into contact with the drill point 52, to grind the same, before the elevator rod 220 (wheel 134) has reached its uppermost position.

Figure 19:
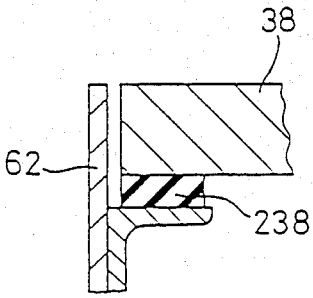
FIG. 19 is a fragmentary elevational view in cross section, indicating a structural relation between a top plate and a front plate of the grinder of FIG. 1.

The top plate 38 rests on the upper ends of the front plate 62 and a rear plate (not shown), via a vibration-damping rubber cushion 238, as indicated in FIG. 19. Further, the instant grinder 10 is equipped with a chip pan 240 as shown in FIG. 4, which is removably disposed under the main frame, so as to receive metal particles produced during a grinding operation. The grinder 10 is provided with side plates 242, 244 which cover the right and left sides of the main frame. These side plates 242, 244 may be removed to permit easy maintenance of the grinder 10. As indicated in FIG. 15, the side plate 242 has a round hole 246 through which the cylindrical block 184 of the positioning device 174 extends. The round hole 246 has a sufficiently large diameter to permit the cylindrical block 184 to be vertically moved with the elevator rod 220, without an interference with the side plate 242.

The operation of the instant embodiment will be described below.

Initially, the second chuck 18 of the drill holder 12 is set in the drill setting device 36, and the position of the abutting block 42 is adjusted by turning the operating knob 78, depending upon the web thickness of the drill 14 to be ground. Then, the first chuck 16 gripping the shank 26 of the drill 14 is inserted into the second chuck 18 until the point 52 of the drill 14 abuts on the abutting block 42. The drill 14 is rotated by rotating the first chuck 16, until the cutting edge 58*a* or 58*b* comes into contact with the side face 60 of the circumferential stop 54. The drill 14 is then gripped at its body 34 by the second chuck 18. In this manner, the drill 14 is fixed in the drill holder 12, with the predetermined distance of projection from the second chuck 18, and at the predetermined circumferential position.

Before the drill holder 12 holding the drill 14 is set in the holder mounting device 86, the positioning clamp lever 100 is manipulated to bring the positioning pin 94 to its retracted position, and the rotating lever 132 is moved to the position X for engagement with the cutout 142. Also, the positioning lever 208 of the positioning device 174 is operated for engagement with the cutout 210, to place the grinding wheel 134 in the first position (for grinding the first lip clearance 150), while the elevator lever 236 of the wheel elevator 218 is operated to place the elevator rod 220 (grinding wheel 134)

in the lowermost position. Further, the operating knob 168 is manipulated to adjust the position of the peripheral plate cam 128, according to the specific diameter of the drill 14.

After the above preliminary settings are completed, the drill holder 12 is inserted into the mounting block 88 of the holder mounting device 86, such that the cutout 102*a* or 102*b* formed in the outer circumferential surface of the second chuck 18 is aligned with the retracted positioning pin 94. The lever 100 is then operated to advance the positioning pin 94 to clamp the drill holder 12 at the predetermined axial and circumferential positions. Thus, the drill 14 fixed in the drill holder 12 with the predetermined axial and circumferential orientations relative to the second chuck 18 can be held at the predetermined axial and circumferential positions relative to the mounting block 88.

In this condition, the elevator lever 236 is turned to elevate the elevator rod 220, whereby the grinding wheel 134 rotated by the motor 198 is brought into contact with the point 52 of the drill 14, as indicated in one-dot chain line in FIG. 9, before the elevator rod 220 reaches the uppermost position. Thus, the first lip clearance 150 of the drill 14 is ground by the circumferential surface 154 of the wheel 134.

After the grinding of the first lip clearance is completed in the manner described above, the elevator lever 236 is operated to bring the elevator rod 220 and consequently the grinding wheel 134 into the lowermost position, and the wheel-axis positioning lever 208 is turned for engagement with the cutout 212, to thereby place the grinding wheel 134 in the second position for grinding the second lip clearance 152. Then, the rotating lever 132 is moved to the position Y. In this condition, the elevator lever 236 is turned to elevate the elevator rod 220 to bring the grinding wheel 134 into contact with the point 52 of the drill 14, as indicated in two-dot chain line in FIG. 9. Subsequently, the rotating lever 132 is moved through the cutout 144 between the positions Y and Z, whereby the second lip clearance 152 is ground by the circumferential surface 154 of the grinding wheel 134, while at the same time the arcuate portion 148 of the other cutting edge 58*b*, 58*a* is ground.

The above steps of operation complete the grinding operations of the first and second lip clearances 150, 152 of one of the two cutting edges 58*a*, 58*b*, and the arcuate portion 148 of the other cutting edge 58*b*, 58*a*. Successively, the drill holder 12 is loosened and rotated by 180 degrees, and reclamped in the holder mounting device 86. In this condition, the same steps of operation as discussed above are repeated, whereby the first and second lip clearances 150, 152 of the above-indicated other cutting edge 58*b*, 58*a*, and the arcuate portion 148 of the above-indicated one cutting edge 58*a*, 58*b* are ground by the grinding wheel 134. Thus, all necessary steps of operations to grind or recondition the drill 14 are implemented.

In the present drill grinder 10, the drill holder 12 for holding the drill 14 to be ground consists of the first and second chucks 16, 18. Since these two separate chucks 16, 18 hold the drill 14 at the corresponding two portions of the drill 14, that is, the shank 26 and the body 34, the drill 14 is protected from undergoing elastic deformation due to a grinding force applied from the grinding wheel 134 to the point 52 of the drill 14. Consequently, the drill holder 12 eliminates otherwise possible radial displacement or misalignment of the drill point 52 relative to the grinding wheel 134, and thus assures a high degree of accuracy of grinding the cutting edges 58*a*, 58*b*.

Further, the drill 14 is accurately preset in the drill holder 12, by the drill setting device 36, so as to establish the predetermined distance of projection from the second chuck 18, and the predetermined circumferential or angular position relative to the second chuck 18. The thus preset drill 14 held in the drill holder 12 can be readily set in position in the drill grinder 10, by installing and clamping the drill holder 12 in the mounting block 88 of the holder mounting device 86, at the predetermined axial and circumferential positions of the second chuck 18 relative to the mounting block 88. Hence, the instant arrangement assures improved grinding accuracy.

It is noted that the grinding of the arcuate portion 148 of each cutting edge 58a, 58b of the drill 14 requires the drill 14 to be moved in a radial direction away from the grinding wheel 134 and in an axial direction toward the wheel 134, while the drill 14 is rotated about its axis. These concurrent radial, axial and rotational movements of the drill 14 can be achieved in the present embodiment. Namely, the mounting block 88 holding the drill holder 12 is moved along the obliquely extending guide rods 114 in the right-downward direction as indicated in FIG. 11, by means of engagement between the cam follower 126 and the peripheral plate cam 128, while the mounting block 88 is rotated by turning the rotating lever 132 from the position Y to the position Z. Thus, the present arrangement permits precise grinding of the arcuate portion 148 of the drill 14, without a high standard of skill of the operator.

In the present drill grinder 10, the grinding wheel 134 and the motor 198 to drive the wheel 134 are housed within the main frame, in order to protect the operator from otherwise possible hazardous conditions such as contact of the operator's hands with the grinding wheel 134, or catching of the operator's clothes by the motor assembly, during a grinding operation, thus providing a high degree of operating safety. Further, provisions are made for preventing scattering of metal particles produced in a grinding operation, so as to maintain good operating environments. In this respect, the chip pan 240 adapted to receive the metal particles contributes to easy disposal of the particles, and facilitates the cleaning procedure.

While the present invention has been described in detail in its preferred embodiment, it is to be understood that the invention may be otherwise embodied.

For instance, the drill holder 12 consisting of the first and second chucks 16, 18 which are axially movable and rotatable relative to each other in the illustrated embodiment, may be modified such that the first and second chucks 16, 18 for gripping the shank 26 and body 34 of the drill 14 are not axially movable relative to each other.

While the drill holding device used in the illustrated embodiment is provided in the form of the drill holder 12 separate from the holder mounting device 86, it is possible to modify the holder mounting device 86 of the drill grinder 10 so as to accommodate the drill 14. In this case, the modified mounting device 86 must have a first chuck portion for gripping the shank 26 of the drill, and a second chuck portion for gripping the body 34 of the drill.

Although the axial and circumferential positions of the drill 14 relative to the holder mounting device 86 are established by the second chuck 18 of the drill holder 12 in the illustrated embodiment, it is possible that the first chuck 16 gripping the shank 26 of the drill 14 functions to orient the drill relative to the holder mounting device 86.

In the illustrated embodiment, the drill 14 is moved in both radial and axial directions relative to the grinding wheel 134 by means of engagement of the cam follower 126 with the plate cam 128, a radial movement of the drill 14 may be eliminated, if the configuration of the drill point 52 does not require such a radial movement.

While the plate cam 128 used in the illustrated embodiment is adapted to be pivoted about the pin 158, the plate cam 128 may be fixedly secured to the top plate 38 where the diameter of the drill 14 is substantially constant. It is also possible to fix a plate cam (128) to the holder mounting device 86, and a cam follower (126) to the top plate 38.

Although the illustrated embodiment is adapted to grind the drill point 52 by elevating the grinding wheel 134 toward the drill point 52, the drill 14 may be lowered toward the grinding wheel 134.

In the illustrated embodiment, a grinding operation is performed by means of manipulation of the operating levers 100, 132, 208 and 236 by the operator, it is possible that the corresponding operations may be partially or entirely performed automatically by pneumatically or hydraulically operated actuators, or by electrically operated stepping motors.

It will be understood that the present invention may be embodied with various other changes, modifications and improvements, which may occur to those skilled in the art, without departing from the spirit and scope of the invention defined in the following claims.

What is claimed is:

1. A drill grinder for grinding a point of a drill including a shank, and a body which has said point, said drill grinder comprising a holding device for removably holding said drill, and a grinding wheel adapted to be forced on said point and thereby grind said point while said drill is held by said holding device, wherein the improvement comprises:

said holding device including a first chuck for gripping said shank of the drill, and a second chuck for gripping said body of the drill;

a holder mounting device for removably holding said holding device during a grinding operation on said point of the drill by said grinding wheel;

a drill setting device for removably accommodating said holding device, said drill setting device including a circumferential stop for an abutting contact with one of plural cutting edges formed at said point of the drill, to position said drill in a circumferential direction relative to said second chuck, prior to said grinding operation; and said first and second chucks including respective cylindrical portions which slidably engage each other such that the first and second chucks are rotatable and axially movable relative to each other, said first and second chucks gripping said drill such that the drill is held in a predetermined circumferential position relative to said second chuck, said predetermined circumferential position being established by axially moving and rotating said first chuck and said gripped drill relative to the second chuck in order to obtain said abutting contact of said circumferential stop with said one cutting edge.

2. A drill grinder according to claim 1, wherein said drill setting device further includes a mounting block for positioning said second chuck in both axial and circumferential positions thereof, and an abutting block disposed below said mounting block and having said circumferential stop, said abutting block having a surface for an abutting contact with said point of the drill such that said body extends through said second chuck, and projects from said second chuck by a predetermined axial distance, and such that said drill is held in a predetermined circumferential position relative to said second chuck.

3. A drill grinder according to claim 2, further comprising adjusting means including a rotary operating member operable to move said abutting block relative to said mounting block in a radial direction of said drill held by said holding device, according to a thickness of a web of said drill, so as to avoid an interference of said circumferential stop with said web.

4. A drill grinder according to claim 1, wherein said second chuck has circumferential positioning means corresponding to a circumferential position of said one cutting edge of the drill, each of said drill setting device and said holder mounting device having means engageable with said circumferential positioning means of said second chuck, said holding device being positioned relative to said holder mounting device by means of said circumferential positioning means.

5. A drill grinder according to claim 1, wherein each of said cutting edges of the drill has an arcuate portion near a dead center of the drill, said drill grinder further comprising guiding means for moving said holder mounting device in a radial direction of the drill away from said grinding wheel, and in an axial direction of the drill toward said grinding wheel, in response to rotation of said holder mounting means about an axis of the drill, whereby said arcuate portion of the cutting edge is ground along its profile, said guiding means including a cam mechanism.

6. A drill grinder according to claim 5, wherein said point of the drill has a pair of cutting edges symmetrical with each other with respect to said axis of the drill, each of said pair of cutting edges including a first lip clearance and a second lip clearance following said first lip clearance, and wherein said guiding means guides said holder mounting device so as to grind said second lip clearance of one of said pair of cutting edges by an outer circumferential surface of said grinding wheel, while simultaneously grinding said arcuate portion of the other cutting edge by one of opposite surfaces of said grinding wheel.

7. A drill grinder according to claim 6, further comprising support means including a support block on which said grinding wheel is supported rotatably about an axis perpendicular to the axis of said drill, said support block being supported pivotably about a pivot axis which is parallel to the axis of said grinding wheel and spaced apart from said axis of the grinding wheel, said drill grinder further comprising an operating member for pivoting said support block between a first position in which said grinding wheel grinds said first lip clearance of the drill, and a second position in which said grinding wheel grinds said second lip clearance.

8. A drill grinder for grinding a point of a drill including a shank, and a body which has said point, said drill grinder comprising a holding device for removably holding said drill, and a grinding wheel adapted to be forced on said point and thereby grind said point while said drill is held by said holding device, wherein the improvement comprises:

said holding device including a first chuck for gripping said shank of the drill, and a second chuck for gripping said body of the drill, said first and second chucks engaging each other such that the first and second chucks are rotatable and axially movable relative to each other, said first and second chucks gripping said drill such that the drill is held in a predetermined circumferential position relative to said second chuck;

a holder device for removably holding said holding device during a grinding operation on said point of the drill by said grinding wheel;

rotary support means for supporting said holder mounting device rotatably about an axis thereof;

an operating member for rotating said holder mounting device and consequently said holding device holding said drill;

a pair of parallel guide rods which are inclined relative to the axis of said holder mounting device and which slidably support said rotary support means; and a cam mechanism which includes a stationary cam, and a cam follower which is secured to said holder mounting device and engageable with said stationary cam to move said rotary support means along said guide rods, when said holder mounting device is rotated by said operating member, whereby a rotary movement of said holder mounting device causes said drill, held by said holding device mounted on said holder mounting device, to be moved in a radial direction thereof away from said grinding wheel, and in an axial direction thereof toward said grinding wheel.

9. A drill grinder according to claim 8, wherein said cam consists of a peripheral cam in the form of a plate having a cam surface, said cam mechanism including a pin which extends parallel to the axis of said holder mounting device, to support said peripheral cam pivotally, said drill grinder further comprising an operating member for pivoting said peripheral cam about said pin to change a position of said cam surface relative to said cam follower, according to a diameter of said drill.

* * * * *